United States Patent [19]

Oldershaw

[11] 4,351,374

[45] Sep. 28, 1982

[54] POUCH FILLING MACHINE

[75] Inventor: C. G. Peter Oldershaw, Avon, N.Y.

[73] Assignee: General Foods Corporation, White Plains, N.Y.

[21] Appl. No.: 213,430

[22] Filed: Dec. 5, 1980

[51] Int. Cl.[3] ..... B65B 1/08; B65B 43/60

[52] U.S. Cl. ..... 141/71; 53/525; 141/131; 141/132; 141/183; 141/191; 198/569; 222/197; 222/254

[58] Field of Search ..... 53/266 R, 272, 525; 141/71, 72, 131, 132, 181, 182, 183, 284, 324, 191; 222/197, 199, 254, 270, 271; 198/569

[56] References Cited

U.S. PATENT DOCUMENTS 3,478,492 11/1969 Cloud et al. ..... 53/266

3,941,170 3/1976 Maulini ..... 141/183

*Primary Examiner*—Frederick R. Schmidt

*Attorney, Agent, or Firm*—Daniel J. Donovan; Thomas V. Sullivan; Bruno P. Struzzi

[57] ABSTRACT

A horizontal filler comprising a rotating turret supporting open-top containers and mounting a turntable for receiving a falling stream of particulate material is provided with tiltable trays on said turntable disposed to collect individual divided amounts of material from said stream for discharge gradually and individually into respective ones of said containers.

9 Claims, 6 Drawing Figures

6
7
8
10
11
12
13
15
20
21
22
23
24
25
26
27
28
29
30
31
32
33
35
36
37
38
41
42
43
44
45
46
47
48
49

FIG. 4.
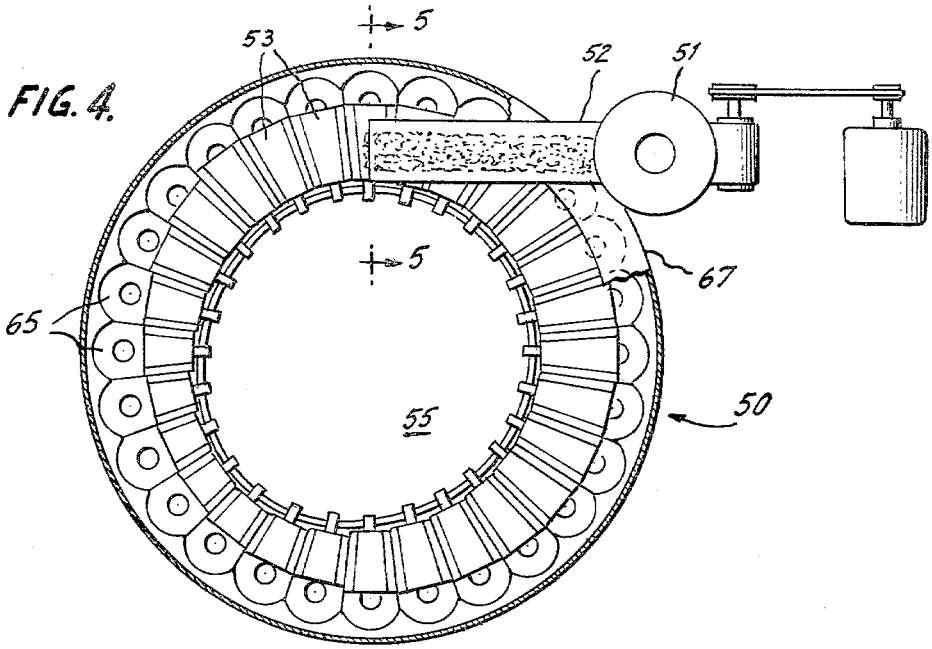
FIG. 5.
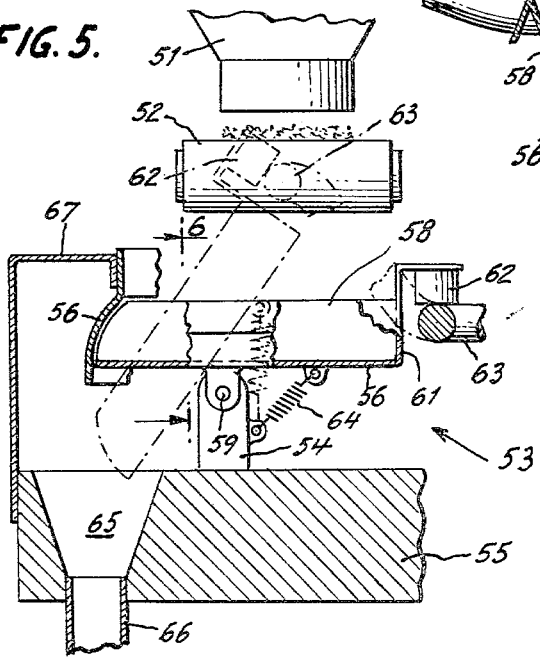
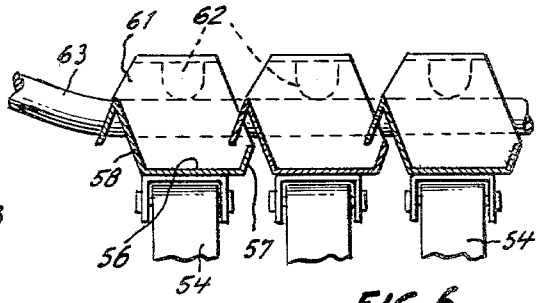
FIG. 6.

POUCH FILLING MACHINE

BACKGROUND OF THE INVENTION

1. Field of the Invention

This invention relates generally to high speed continuous motion packaging machinery designed for filling relatively small containers with a particulate product or material. The invention relates more particularly to filling equipment of this character adapted to accurately dispense, into pouches formed of flexible packaging material or other narrow mouth containers, a particulate product which may contain fatty or gummy ingredients in a relatively high proportion.

The invention is disclosed herein in an embodiment constituting a modification of a commercially available and widely-used machine known as the Pouch King, manufactured and sold by the R. A. Jones & Company, Inc. of Cincinnati, Ohio. The basic features of such machine are disclosed in U.S. Pat. No. 3,453,799 to Charles E. Cloud et al. issued July 18, 1969. Additional patents disclosing various features of said machine are shown in U.S. Pat. Nos. 3,563,001 issued Feb. 16, 1971 and 3,478,492 issued Nov. 18, 1969, to C. E. Cloud et al.

A typical filler machine of this character may comprise a turret-like structure, the upper section of which constitutes a continuously rotating turntable onto the surface of which product is continuously deposited in an accurately metered amount. The lower section of said turret carries around its sides a continuous web of packaging material which has been formed into a succession of open top pouches by a series of folding and/or sealing steps performed in earlier stages in the overall packaging system. Arranged around the periphery of the turntable is a series of funnel-shaped cavities into which the product, deposited as a ribbon on the rotating turntable, is deflected seriatim and gradually to avoid plugging the necessarily small diameter spouts leading from each of said cavities. Utilizing a turret structure in this manner for a filler apparatus allows sufficient time in the overall packaging operation for the gradual filling of pouches while still permitting web feed to proceed at speeds compatible with that of other components of the overall system.

In this typical construction the carefully metered product, laid down on the rotating turntable in a ribbon formation, is gradually deflected by a fixed plow positioned immediately above the turntable surface and extending from the metering block to the periphery of the table in an arc having a radius somewhat greater than that of the turntable. In this manner the product is plowed and worked starting from the inner edge of its ribbon formation until as the turntable continues rotating, the entire ribbon width of it is eventually pushed into the peripherally arranged cavities which are in direct communication with underlying pouches.

It will be understood that in such apparatus the uniformity of fill weight is dependent on the uniformity of the ribbon of product leaving the metering block together with the uniformity with which the product is plowed or deflected into the cavities at the periphery of the turntable. When the inner edge of the ribbon encounters the stationary plow it is retarded by the frictional engagement therewith while the outer edge continues moving at the velocity of the turntable. This velocity combined with the folding action of the plow produces a complexity of product movements that must be maintained in a steady state condition or dynamic balance to guarantee constant uniform fill weights. Any irregularities in the face of the plow or any changes in the frictional forces between the product and the plow or the product and surface of the turntable can cause a momentary buildup and subsequent sudden release of irregular or abnormal amounts of product to result in unacceptable weight variations among the filled pouches.

Furthermore, with such apparatus some product inevitably gets beneath the plow and smears onto the table surface, occasionally breaking away in pieces large enough to plug the fill spouts. This difficulty is encountered particularly with products containing fats, oils or gums.

2. Description of the Prior Art

Another approach known to the art for filling flexible containers with a measured amount of granular product involve first filling a measuring cup or receptable up to a predetermined level and then subsequently discharging the product from the cup in its entirety. One example of such approach is shown in patent to Rose et al. U.S. Pat. No. 2,657,832. Another example is disclosed in the patent to Thurlings, U.S. Pat. No. 3,042,260. A still further example is disclosed in patent to Lense U.S. Pat. No. 3,265,251. In each of these various examples the product is deposited in the respective measuring cups by movement thereof from the supply hopper by means acting in a plow-like manner, thus giving rise to problems of the sort hitherto mentioned in conjunction with the steady state or dynamically stable approach of the aforementioned patents to Cloud et al. Furthermore, the approach of premeasuring the product by filling a measuring cup to its capacity before it can be discharged into the ultimate pouch involves additional time factors and also additional mechanical devices which are hindrances to achieving a high operating efficiency such as can be achieved when the measuring function is accomplished by mechanism operating to feed the product in a steady stream for division into separated and measured amounts by close coordination of the feed rate with the advance of the web, all in a steady state condition wherein a dynamic balance between the operation of the respective parts is maintained.

SUMMARY OF THE INVENTION

The filler machine according to the instant invention employs a continuously rotating turntable of the general type disclosed in the aforementioned patents to Cloud et al. and in one embodiment includes a flat ring having a series of contiguous peripherally arranged funnel-shaped cavities formed thereon. A metering means, also continuously operating, is disposed to drop a steady stream of product onto the peripheral edge of said ring and into said cavities in succession, which cavities do not hold the product but serve to divide it evenly with the parts being driven at carefully adjusted relative speed ratios and in dynamic balance so as to cause a predetermined amount of the product to be in effect divided out of said falling stream. Since the amount of product falling into each cavity in a given time interval is greater than the amount which can be discharged in a similar interval into the relatively small opening of the receiving pouch carried by the underlying turret, there is provided beneath each of said cavities an open ended receiving tray which temporarily collects the charge of product divided out for a respective pouch and subsequently releases or discharges it gradually into its respective pouch at the filling stage of said apparatus. This is done at a rate commensurate with the size of the pouch to be filled and also commensurate with the velocity of the pouches feeding around said turret structure. In one form of the apparatus said receiving trays are spring mounted for a flexing action by which they are tilted such that collected product flows freely out the open end thereof and into the associated fill funnel. In another embodiment of the invention wherein said trays are designed to also divide out measured amounts of product received directly from the metering means, the trays are pivotally mounted and are tilted by a rocking action from a stationary cam to achieve the same result. In both forms of the invention means may be provided for vibrating the trays when in the tilted condition so as to assure that all of the product received in the tray is discharged therefrom at the proper time in the fill cycle.

Thus, it will be seen that the product is transported from the supply hopper into the respective pouches in measured quantities with a minimum of mechanical working thereof and without subjection to any of the resistant forces and frictional stresses usually associated with plowing devices and the like. The travel of product from the metering belt completely through the equipment into the pouch is solely by way of gravity which places no stresses or strains on the product, and it avoids the risks of temporary buildups or backflashes at any stage in the operation which is of special advantage in applications where products having a gummy or fatty constituent is involved. The mechanism enables accurate measurement of quantities for the respective pouches in a steady state or dynamically balanced operation between the continually driven product metering mechanism and the cooperating continuously rotating turntable, thus achieving the desired result with a minimum of mechanism and in a highly efficient manner.

It is therefore an object of the invention to improve upon means operating to continuously fill open mouth containers with precisely measured quantities of a particulate material.

It is a further object of the invention to enable the filling of containers with a particulate product without mechanically working product such as with plows or the like.

It is still a further object of the invention to separate measured amounts from a steady stream of a particulate product by maintaining a dynamic balance between the product flow rate from metering mechanism discharging a steady stream of the product onto stream dividing means through which the product passes on its route to the respective pouches and the rotational velocity of said dividing means which determines the amount of product which will be divided out for each respective pouch.

Further object of the invention together with the features contributing thereto and the advantages accruing therefrom will be apparent from the following description when read in conjunction with the drawing wherein:

BRIEF DESCRIPTION OF THE DRAWING

FIG. 4 is a plan view of a filling machine in accordance with a second embodiment of the invention.

FIG. 5 is a sectional view in elevation taken along the line 5—5 of FIG. 4.

FIG. 6 is a detail view in elevation of the product collecting tray feature of the apparatus.

DETAILED DESCRIPTION

Figure 1:
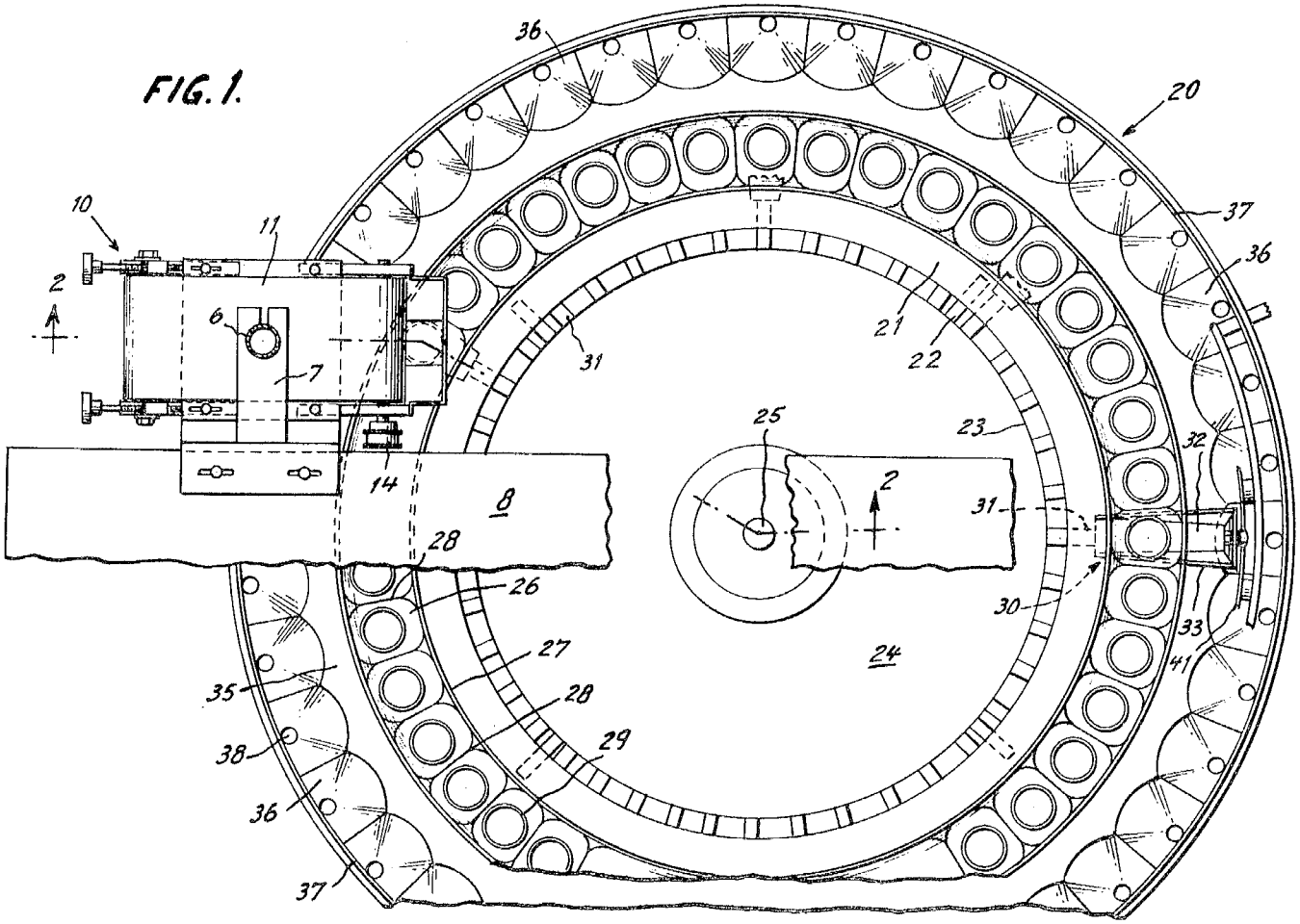
FIG. 1 is a plan view of a filler in accordance with the invention according to a first embodiment thereof.

Referring now to the drawing, the particulate material or product to be packaged by the apparatus is contained in bulk form in a supply hopper 5 suitably supported by framework, not shown, the discharge spout 6 of which is connected or attached to a support bracket 7 carried by the main frame 8 of the apparatus. Also supported by the bracket 7 directly below the discharge spout 6 is a metering means 10 comprised of a continuously driven feed or metering belt 11 drawn around a pair of rolls 12 mounted on the shafts 13 of which one carries a pulley 14 through which, by means of an appropriate drive belt and a motor not shown, the metering means is continuously driven to advance the belt 11 in a clock-wise direction at a carefully controlled rate synchronized with the drive for the other components of the filler apparatus to be hereinafter described. Through appropriate gating or other control means well-known a predetermined amount of product is continuously dropped onto the surface of the belt 11 in a ribbon-like pattern and transported in such pattern at a velocity which is commensurate with the amount of product being deposited thereon so as to maintain uniformity in the amount of product being supplied to the apparatus at all times.

The product is discharged from the metering belt 11 into a funnel 15 attached to the discharge end of the belt and having its discharge spout disposed in a predetermined relation to and directly above a horizontally disposed and continuously driven turntable 20. The turntable comprises an assembly which includes a horizontally disposed product distributing ring 21 secured by circumferentially spaced shims 22 to the raised rim 23 of a circular disc 24 suitably mounted for rotation, in a counter-clockwise direction as viewed in FIG. 1, on a vertical shaft 25.

Formed in the surface of the ring 21 is a series of contiguous funnel-shaped cavities 26 which act during the rotation of the turntable to separate or divide out measured amounts of product being continuously discharged from the discharge funnel 15, it being noted that the discharge spout of the funnel is disposed in centered registration with the rotating cavities, i.e., at the same radial distance from the axis of shaft 25. The cavities are further defined by inner and outer bands 27 circumferentially disposed and fitted in the surface of the ring 21 so as to constitute part of the inner and outer walls of the respective product dividing cavities. The side walls of adjacent cavities taper upwardly to a sharp point 28 or line of division between the respective cavities so that as the turntable rotates all of the product will be received in one or another cavity without the possibility of any collecting on a surface area between adjacent cavities. A tubular insert 29 defines the lower spout portion of the respective cavity.

Disposed directly beneath each cavity 26 is a product collecting member in the form of an open-ended tray or chute 30 supported by a flat or leaf spring 31 secured at its inner end to the rim 23 of the rotatable disc 24. The bottom flat surface 32 of the tray 30 is disposed to normally slope slightly downward in the outward direction, and the tray side walls flare outwardly from bottom to top so as to accommodate the lower tip of the spout 29 and provide assurance that the entire charge of measured product is directed into the tray.

The base or bottom member of the turntable 20 carried by shaft 25 comprises a circular plate 35 the peripheral edge of which is shaped to form a series of contiguous funnels 36 in combination with an upstanding retainer wall 37 circumscribing the plate and constituting the outer wall of the respective funnels. The arrangement is such that there is one funnel associated with each tray 32 and disposed to receive product which gradually runs down the sloping surface of the tray and off the discharge end thereof as the turntable rotates through the fill portion of its rotational cycle. A spout 38 fitted to the bottom of each fill funnel is dimensioned appropriately for pouch filling purposes.

Figures 2, 3:
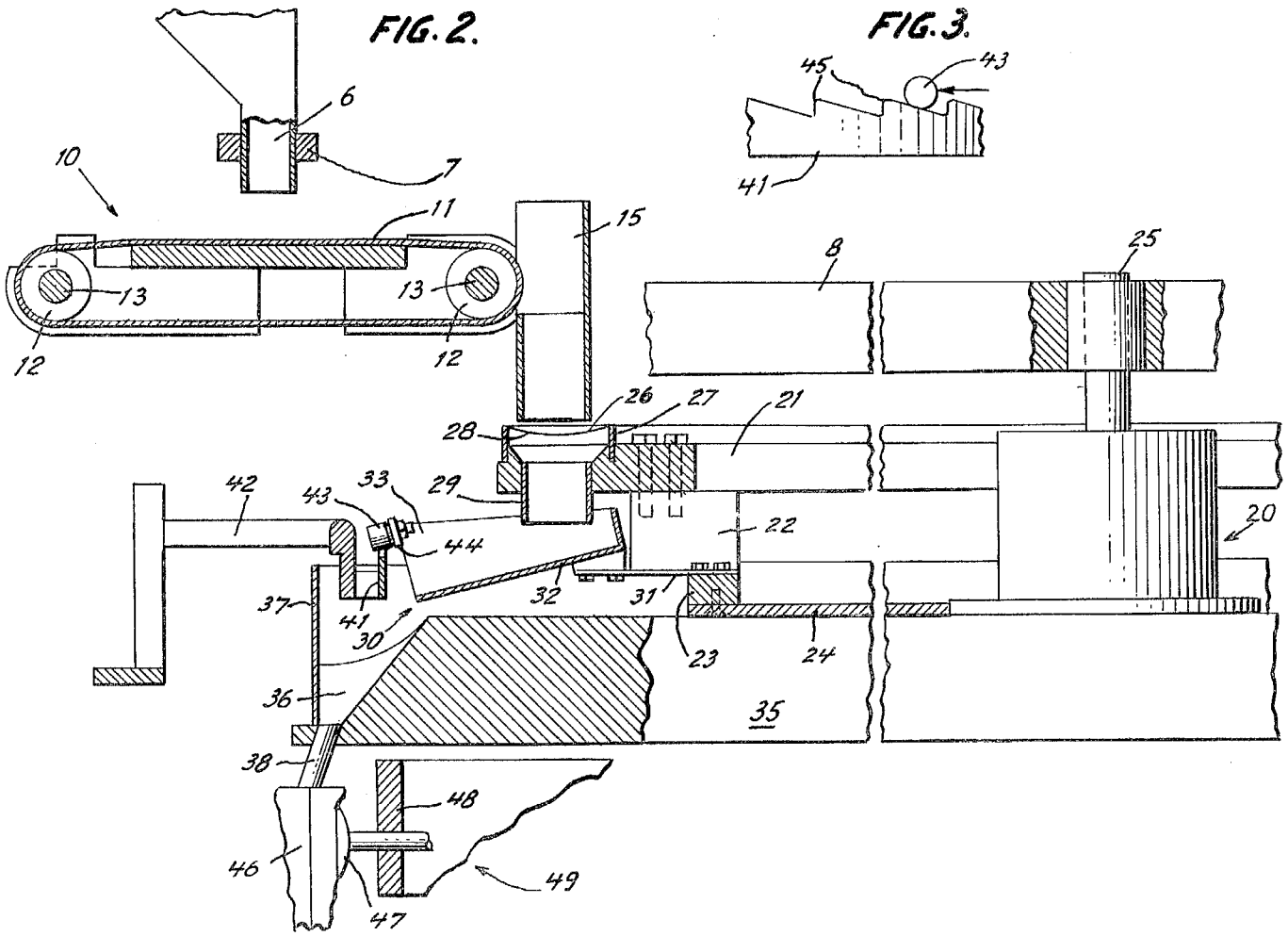
FIG. 2 is a sectional view taken along the line 2—2 of FIG. 1.
FIG. 3 is a fragmentary detail view of a portion of the cam rail shown on FIG. 2.

By virtue of the slope of the bottom surface of the tray 30, in a radially outward and downward direction, the product collected by the tray gradually slides down the sloping surface and falls off the outer edge thereof so as to be discharged into the funnel 36 at a controlled and even rate of flow such as to avoid overloading or clogging the relatively and necessarily small dimensioned fill spout 38. The degree of slope of the bottom surface of the tray 30 can be adjusted to match the flowability characteristics of the particular product being packaged, and for this purpose there may be provided a fixed cam 41 in the form of a ring or rail disposed around the periphery of the turntable structure and supported by a bracket 42 attached to the machine frame. The cam underlies and cooperates with a cam follower 43, which may be in the form of a roller or the like, mounted on a strap 44 interconnecting the outer edges of the side walls 33 of the tray. The roller is yieldingly biased into engagement with the rail by virtue of the leaf spring 31 which supports the tray 30 as aforementioned. Furthermore, the cam 41 preferably has its camming surface serrated or formed with teeth 45 in a saw-tooth pattern, as can be seen in FIG. 3, which by action of the spring 31 causes the tray to vibrate as it traverses the fill section of its rotational cycle, thereby assuring that the entire amount of product collected by the tray will be discharged into the fill funnel 36 during its traversal through the fill stage of the cycle.

The product discharged into the fill funnels is directed by a fill spout 38 into a respective open top pouch 46 which may be supported by a vacuum cup 47 mounted in the side wall 48 of the underlying turret structure 49. As more fully shown and described in the aforementioned patents to Cloud et al., said pouches are formed in a continuous web which is entrained around a major portion of the filler's periphery with each pouch being held by vacuum means or the like in registration with a respective one of the fill funnels for a sufficient span of the rotational cycle as to enable it to be properly filled by the regulated and uniform flow of product thereinto from the fill funnel and associated filling mechanism. At the completion of the fill portion of the rotational cycle the continuous web of pouches is released from the turret structure and drawn through top sealing mechanism wherein the top seals are made in preparation for cutting of the web into individual pouch units and eventual loading of the pouches into suitable containers or cartons for shipping or storing purposes.

FIGS. 4 through 6 illustrate a modified embodiment of the invention wherein product delivered from a metering means is collected directly into collecting trays which are designed so as to also separate or divide the stream of metered product uniformly into the predetermined amount required to achieve the proper filling of the respective pouches.

As shown, the product is supplied to a turntable 50 from a hopper 51 which discharges it onto a motor driven metering belt 52. The discharge end of the belt 52 is disposed directly above and in vertical registration with a circular series of contiguous product collecting trays 53 pivotally mounted on support posts 54 secured to the upper surface of the continuously rotating turntable plate 55. The trays 53, as may best be seen in FIG. 6, are formed with a flat bottom surface 56 and opposed side walls 57, 58 bent up therefrom of which wall 57 is relatively short. The opposed wall 58 is higher and sharply bent over to in effect overlap the short side wall 57 of the adjacent tray. The inner end wall 61 of the tray is bent over and carries a cam follower 62 which may be a roller disposed in bearing engagement with a stationary cam ring or rail 63 under influence of a spring 64 stretched between the bottom 56 of the tray and the post 54. Said cam ring 63 is suitably mounted in the frame of the apparatus by means not shown.

The radially outer end of each tray 53 is open and normally disposed directly above and in vertical registration with a respective fill funnel 65 formed in the turntable plate member 55 near the periphery thereof and in communication with a fill spout 66 running to the respective pouch to be filled.

When the tray is in its normal collecting orientation or position, the bottom surface thereof is substantially horizontal, which is the full line position shown in FIG. 5, in which position the outer open end thereof is effectively sealed off by a shield member 56 supported by a bracket 67 attached to the peripheral surface of turntable 55. The shield 56 prevents product, while being dropped from the metering block into a tray, from spilling out the end of the tray before the intended start of the fill portion of a cycle. At the start of the fill portion of a cycle the cam ring starts to deviate from parallelism with the surface of the turntable plate 55 rising therefrom to tilt the tray about its pivot 59, as shown in dotted lines in FIG. 5, to thereby discharge the product into the fill funnel at a controlled and uniform rate with the angle of tilting being predetermined in accordance with flowability of the product being handled so as to complete the filling of the respective pouch within the time allotted by the fill portion of a cycle and without discharging into the fill funnel product at a rate in excess of its capacity to handle.

In this latter embodiment the design of the trays 53, with each having a side wall 58 which overlaps the side wall 57 of an adjacent tray so as to eliminate any voids between the respective trays, enables the trays themselves to perform a product dividing or distributing function as well as a collecting function because the folded-over wall 58 at the sharp fold angle thereof presents a narrow line of division for diverting the stream of product falling from the metering block into one tray on the other. Also, in the latter described embodiment the degree of tilting which may be afforded the collecting tray 53 is somewhat greater than in the earlier described embodiment and this feature provides advantages for use with certain types or products, especially those of high gum or fat content in which the flowability characteristics are of relatively low order. It, of course, should also be understood that in the latter embodiment, if desired, the cam 63 could be provided with a serrated or saw-tooth surface in the area thereof whereat the actual pouch filling and discharge of the tray is accomplished.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to any thing less than the whole of the invention herein disclosed as hereinafter claimed.

I claim:

1. In an apparatus for serially filling each of a succession of individual open top containers with a predetermined amount of particulate material flowable under the influence of gravity and dischargeable from a bulk supply thereof in a free flowing stream at a uniform predetermined rate of flow, said apparatus including a continuously rotating turret member having means for supporting said containers through a predetermined arc of rotation, a turntable mounted above said turret member and rotatable in unison therewith, said turntable including material distributing means arranged circumferentially thereon and disposed to intercept said stream during rotation of said turret for separation and collection thereof individually in said predetermined amounts, said material distributing means including open-ended tray members mounted for tilting motion when traversing said predetermined arc of rotation for individually collecting said predetermined amounts of material, said trays when tilted discharging said predetermined amounts of material into a respective one of said container, cam means operable for controlling the gradual discharge of said collected individual amounts of material into a respective one of said containers during said predetermined arc of rotation of said turntable, and said turntable including a member disposed beneath said tray members and formed with individual fill funnels disposed to receive product discharged from the open-end of said tray members when in the tilted position, said funnels being effective for directing said discharge product into a respective one of said containers carried by said turret member.

2. The invention according to claim 1, wherein said cam means includes a stationary member bearing on said tray members to tilt the latter into material discharging position as said trays traverse said predetermined arc of rotation.

3. The invention according to claim 2, wherein said tray members are spring biased into engagement with said stationary cam member and said latter member is formed with a serrated camming surface to vibrate said trays when traversing said predetermined arc of rotation in the tilted condition.

4. In an apparatus for serially filling each of a succession of individual open-top containers with a predetermined amount of particulate material flowable under influence of gravity and dischargeable from a bulk supply thereof in a free-flowing stream at a uniform predetermined rate of flow, said apparatus including a continuously rotating turret having means for supporting said containers through a predetermined arc of rotation thereof, a turntable mounted above said turret and rotatable in unison wherewith, said turntable including a material distributing member formed with cavities arranged circumferentially thereon and disposed to intercept said stream during rotation thereof to separate therefrom individual predetermined amounts thereof, open-ended trays mounted on said turntable and disposed beneath said distributing member for receiving the individual amounts of said material separated out of said stream by said distributing member, said open-ended trays being mounted for tilting motion when traversing said predetermined arc of rotation for discharging said individual amounts of material into a respective one of said containers, and cam means operable for controlling said collecting means to gradually discharge said individual amounts of material into a respective one of said containers during said predetermined arc of rotation of said turntable.

5. The invention according to claim 4, wherein said cam means include a fixed member disposed to engage said trays and shaped to effective tilting thereof as said trays traverse said predetermined arc of rotational movement of said turntable.

6. The invention according to claim 4, wherein said trays are pivotally mounted and spring biased into engagement with said cam means, said cam means being formed with a serrated surface effective for vibrating said trays when tilted into position for discharging their individual amounts of material.

7. In an apparatus for serially filling each of a succession of individual open-top containers with a predetermined amount of particulate material flowable under influence of gravity and dischargeable from a bulk supply thereof in a free-flowing stream at a uniform predetermined rate of flow, said apparatus including a continuously rotating turret member having means for supporting said containers through a predetermined arc of rotation, a turntable mounted above said turret member and rotatable in unison therewith, said turntable including material collecting members arranged circumferentially thereon and disposed to intercept said stream of material during rotation of said turret for separating therefrom and receiving said predetermined amounts, said collecting member being in the form of open-ended trays disposed in contiguous relation to one another and mounted for tilting movement under the influence of said cam means for discharge of the product collected thereon into a respective one of said containers during said predetermined arc of rotation of said turntable, contiguous side walls of said trays being shaped to interfit with one another providing a sharp line of division between one of said trays and the next, and cam means for actuating said collecting members to gradually discharge said collected predetermined amounts of material into a respective one of said containers during said predetermined arc of rotation of said turntable.

8. The invention according to claim 7, wherein said trays are spring biased for engagement with said cam means, and said cam means are formed with a serrated surface to vibrate said members when tilted to discharge the individual amounts of material collected thereon.

9. The invention according to claim 7, wherein one side wall of each said tray is relatively higher than the opposed side wall of said tray, said higher side wall being bent over to overlap the shorter side wall of the adjoining tray.

* * * * *